US008919459B2

(12) United States Patent
Polyntsev

(10) Patent No.: US 8,919,459 B2
(45) Date of Patent: Dec. 30, 2014

(54) CONTROL SYSTEMS AND METHODS FOR DIRECTIONAL DRILLING UTILIZING THE SAME

(75) Inventor: Oleg Polyntsev, Gloucestershire (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 1291 days.

(21) Appl. No.: 12/539,198

(22) Filed: Aug. 11, 2009

(65) Prior Publication Data

US 2011/0036632 A1 Feb. 17, 2011

(51) Int. Cl.
*E21B 7/00* (2006.01)
*E21B 7/06* (2006.01)

(52) U.S. Cl.
CPC ..... *E21B 7/06* (2013.01)
USPC ..... 175/76; 166/381; 166/383

(58) Field of Classification Search
USPC ..... 166/381, 383; 175/61, 76
See application file for complete search history.

(56) References Cited

U.S. PATENT DOCUMENTS 4,095,655 A * 6/1978 Still ..... 175/19
5,113,953 A 5/1992 Noble
5,265,682 A 11/1993 Russell et al.
5,520,255 A 5/1996 Barr et al.
5,553,678 A 9/1996 Barr
5,553,679 A 9/1996 Thorp
5,582,259 A 12/1996 Barr
5,603,385 A 2/1997 Colebrook
5,673,763 A 10/1997 Thorp
5,682,259 A 10/1997 Worm et al.
5,685,379 A 11/1997 Barr et al.
5,695,015 A 12/1997 Barr et al.
5,706,905 A 1/1998 Barr
5,758,731 A * 6/1998 Zollinger ..... 175/99
5,778,992 A 7/1998 Fuller
5,803,185 A 9/1998 Barr et al.
5,971,085 A 10/1999 Colebrook
6,019,180 A 2/2000 Pafitis et al.
6,026,911 A * 2/2000 Angle et al. ..... 175/24
6,089,332 A 7/2000 Barr et al.
6,092,610 A 7/2000 Kosmala et al.
6,158,529 A 12/2000 Dorel
6,244,361 B1 6/2001 Comeau et al.
6,364,034 B1 4/2002 Schoeffler
6,394,193 B1 5/2002 Askew (Continued)

FOREIGN PATENT DOCUMENTS

WO 2010/043951 A2 4/2010
WO 2012/080812 A2 6/2012
WO 2012/080819 A2 6/2012

*Primary Examiner* — Jennifer H Gay
*Assistant Examiner* — Elizabeth Gitlin
(74) *Attorney, Agent, or Firm* — Chadwick A. Sullivan; Wesley Noah

(57) ABSTRACT

A system for controlling a first module, a second module, and a third module. The system includes: an inlet configured to receive fluid from a fluid source; a first double-stage valve; and a second double-stage valve. The first double-stage valve is actuatable to a first position wherein fluid from the inlet flows through the first double-stage valve to the second double-stage valve and a second position wherein fluid from the inlet flows through the first double-stage valve to the third module. The second double-stage valve is actuatable to a first position wherein fluid flows from the first double-stage valve to the first module and a second position wherein fluid flows from the first double-stage valve to the second module.

25 Claims, 11 Drawing Sheets

(56) References Cited

U.S. PATENT DOCUMENTS

| | | | | |
|---|---|---|---|---|
| 6,419,014 | B1 | 7/2002 | Meek et al. | |
| 6,431,270 | B1 * | 8/2002 | Angle | 166/66.5 |
| 6,438,495 | B1 | 8/2002 | Chau et al. | |
| 6,968,909 | B2 | 11/2005 | Aldred et al. | |
| 7,353,886 | B2 * | 4/2008 | Bloom et al. | 175/51 |
| 7,559,379 | B2 | 7/2009 | Hall et al. | |
| 7,600,586 | B2 | 10/2009 | Hall et al. | |
| 7,610,970 | B2 | 11/2009 | Sihler et al. | |
| 7,779,933 | B2 | 8/2010 | Sihler et al. | |
| 7,798,246 | B2 | 9/2010 | Collins | |
| 8,118,114 | B2 | 2/2012 | Sugiura | |
| 8,590,636 | B2 | 11/2013 | Menger | |
| 2001/0052428 | A1 | 12/2001 | Larronde et al. | |
| 2002/0011359 | A1 | 1/2002 | Webb et al. | |
| 2006/0131030 | A1 | 6/2006 | Sheffield | |
| 2007/0154341 | A1 | 7/2007 | Saenger | |
| 2008/0110674 | A1 | 5/2008 | Jones et al. | |
| 2011/0036632 | A1 | 2/2011 | Polynstev | |
| 2011/0266063 | A1 | 11/2011 | Downton | |
| 2012/0012396 | A1 | 1/2012 | Downton | |
| 2012/0298420 | A1 | 11/2012 | Seydoux et al. | |
| 2013/0000984 | A1 | 1/2013 | Menger et al. | |
| 2013/0199844 | A1 | 8/2013 | Bayliss et al. | |

* cited by examiner

CONTROL SYSTEMS AND METHODS FOR DIRECTIONAL DRILLING UTILIZING THE SAME

BACKGROUND

Controlled steering or directional drilling techniques are commonly used in the oil, water, and gas industry to reach resources that are not located directly below a wellhead. The advantages of directional drilling are well known and include the ability to reach reservoirs where vertical access is difficult or not possible (e.g. where an oilfield is located under a city, a body of water, or a difficult to drill formation) and the ability to group multiple wellheads on a single platform (e.g. for offshore drilling).

Directional drilling devices often utilize a plurality of steering devices arranged in a circle on the exterior surface of a drill string. These steering devices need to be cyclically actuated to achieve steering in desired direction. Conventional control systems for steering devices are unnecessarily complicated and often include a valve for each steering device (e.g., three valves are required to control three steering devices). Accordingly, there is a need for simpler control systems.

SUMMARY OF THE INVENTION

Aspects of the invention provide control systems and methods for directional drilling.

One aspect of the invention provides a system for controlling a first module, a second module, and a third module. The system includes: an inlet configured to receive fluid from a fluid source; a first double-stage valve; and a second double-stage valve. The first double-stage valve is actuatable to a first position wherein fluid from the inlet flows through the first double-stage valve to the second double-stage valve and a second position wherein fluid from the inlet flows through the first double-stage valve to the third module. The second double-stage valve is actuatable to a first position wherein fluid flows from the first double-stage valve to the first module and a second position wherein fluid flows from the first double-stage valve to the second module.

This aspect can have several embodiments. In one embodiment, the first module, the second module, and the third module are bias pads. In another embodiment, the system is received within a drill string. The fluid source can be pressurized drilling fluid within the drill string. In another embodiment, the system can include an exhaust in communication with the first double-stage valve and the second double-stage valve.

The first double-stage valve can include: a first stage in fluid communication with the inlet and in selective communication with the second double-stage valve; a second stage in fluid communication with the inlet and in selective communication with the third module; and a shaft received within the first double-stage valve. The shaft can include: a first valve body received within the first stage and a second valve body received within the second stage.

During actuation of the first double-stage valve to the first position, the shaft can be positioned such that the first valve body is positioned to permit fluid communication between the inlet and the second double-stage valve and the second valve body is positioned to interrupt fluid communication between the inlet and the third module.

During actuation of the first double-stage valve to the second position, the shaft can be positioned such that: the first valve body is positioned to interrupt fluid communication between the inlet and the second double-stage valve; and the second valve body is positioned to permit fluid communication between the inlet and the third module.

The second double-stage valve can include: a first stage having a first chamber in fluid communication with the first double-stage valve and in selective communication with the first module; a second stage having a first chamber in fluid communication with the first double-stage valve and in selective communication with the second module; and a shaft received within the second double-stage valve. The shaft can include a first valve body received within the first stage and a second valve body received within the second stage.

During actuation of the second double-stage valve to the first position, the shaft can be positioned such that the first valve body is positioned to permit fluid communication between the first double-stage valve and the first module and the second valve body is positioned to interrupt fluid communication between the first double-stage valve and the second module.

During actuation of the second double-stage valve to the first position, the shaft can be positioned such that: the first valve body is positioned to interrupt fluid communication between the first double-stage valve and the first module and the second valve body is positioned to permit fluid communication between the first double-stage valve and the second module.

In another embodiment, the first stage of the second double-stage valve further includes a second chamber in fluid communication with the inlet and in selective fluid communication with the first chamber of the first stage of the second double-stage valve; the second stage of the second double-stage valve further includes a second chamber in fluid communication with the inlet and in selective fluid communication with the first chamber of the second stage of the second double-stage valve; and the shaft further includes a third valve body received within the first chamber of the first stage of the second double-stage valve, a fourth valve body received within the second chamber of the first stage of the second double-stage valve, a fifth valve body received within the second chamber of the second stage of the second double-stage valve, and a sixth valve body received within the first chamber of the second stage of the second double-stage valve.

During actuation of the second double-stage valve to the first position, the shaft can be positioned such that the third valve body is positioned to interrupt fluid communication between the second chamber of the first stage and the first chamber of the first stage and the fifth valve body is positioned to interrupt fluid communication between the second chamber of the second stage and the first chamber of the second stage.

During actuation of the second double-stage valve to the second position, the shaft is positioned such that the fourth valve body is positioned to interrupt fluid communication between the second chamber of the first stage and the first chamber of the first stage and the sixth valve body is positioned to interrupt fluid communication between the second chamber of the second stage and the first chamber of the second stage.

In another embodiment, the first double-stage valve can include: a first stage having a first chamber in fluid communication with the inlet, a second chamber in fluid communication with the second double-stage valve and in selective fluid communication with the first chamber, and a third chamber coupled in fluid communication with the exhaust and in selective fluid communication with the second chamber; a second stage having a first chamber in fluid communication with the inlet, a second chamber in fluid communication with the third module and in selective fluid communication with the first chamber, and a third chamber coupled in fluid communication with the exhaust and in selective fluid communication with the second chamber; and a shaft received within the first double-stage valve. The shaft can include: a first valve body received within the third chamber of the first stage; a second valve body received within the first chamber of the first stage; a third valve body received within the first chamber of the second stage; and a fourth valve body received within the third chamber of the second stage.

During actuation of the first double-stage valve to the first position the shaft can be positioned such that: the first valve body is positioned to interrupt fluid communication between the third chamber of the first stage and the second chamber of the first stage; the second valve body is positioned to permit fluid communication between the first chamber of the first stage and the second chamber of the first stage; the third valve body is positioned to interrupt fluid communication between the first chamber of the second stage and the second chamber of the second stage; and the fourth valve body is positioned to permit fluid communication between the third chamber of the second stage and the third chamber of the second stage.

During actuation of the first double-stage valve to the second position the shaft is positioned such that: the first valve body is positioned to permit fluid communication between the third chamber of the first stage and the second chamber of the first stage; the second valve body is positioned to interrupt fluid communication between the first chamber of the first stage and the second chamber of the first stage; the third valve body is positioned to permit fluid communication between the first chamber of the second stage and the second chamber of the second stage; and the fourth valve body is positioned to interrupt fluid communication between the third chamber of the second stage and the third chamber of the second stage.

In another embodiment, the second double-stage valve includes: a first stage having a first chamber in fluid communication with the first double-stage valve, a second chamber in communication with the first module and in selective fluid communication with the first chamber, and a third chamber in fluid communication the exhaust and in selective fluid communication with the second chamber; a second stage having a first chamber in fluid communication with the first double-stage valve, a second chamber in communication with the second module and in selective fluid communication with the first chamber, and a third chamber in fluid communication the exhaust and in selective fluid communication with the second chamber; and a shaft received within the first double-stage valve. The shaft can include: a first valve body received within the third chamber of the first stage; a second valve body received within the first chamber of the first stage; a third valve body received within the first chamber of the second stage; and a fourth valve body received within the third chamber of the second stage.

During actuation of the second double-stage valve to the first position, the shaft can be positioned such that: the first valve body is positioned to interrupt fluid communication between the second chamber of the first stage and the third chamber of the first stage; the second valve body is positioned to permit fluid communication between the first chamber of the first stage and the second chamber of the first stage; the third valve body is positioned to interrupt fluid communication between the first chamber of the second stage and the second chamber of the second stage; and the fourth valve body is positioned to permit fluid communication between the second chamber of the second stage and the third chamber of the second stage.

During actuation of the second double-stage valve to the second position, the shaft can be positioned such that: the first valve body is positioned to permit fluid communication between the second chamber of the first stage and the third chamber of the first stage; the second valve body is positioned to interrupt fluid communication between the first chamber of the first stage and the second chamber of the first stage; the third valve body is positioned to permit fluid communication between the first chamber of the second stage and the second chamber of the second stage; and the fourth valve body is positioned to interrupt fluid communication between the second chamber of the second stage and the third chamber of the second stage.

In another embodiment, the first stage of the second double-stage valve further includes a fourth chamber in communication with the inlet and in selective communication with the first chamber of the first stage of the second double-stage valve; the second stage of the second double-stage valve further includes a fourth chamber in communication with the inlet and in selective communication with the first chamber of the second stage of the second double-stage valve; and the shaft further includes a fifth valve body received within the first chamber of the first stage of the second double-stage valve, a sixth valve body received within the first chamber of the fourth stage of the second double-stage valve, a seventh valve body received within the fourth chamber of the second stage of the second double-stage valve, and an eighth valve body received within the first chamber of the second stage of the second double-stage valve.

During actuation of the second double-stage valve to the first position, the shaft can be positioned such that the fifth valve body is positioned to interrupt fluid communication between the fourth chamber of the first stage and the first chamber of the first stage and the seventh valve body is positioned to interrupt fluid communication between the fourth chamber of the second stage and the first chamber of the second stage.

During actuation of the second double-stage valve to the second position, the shaft can be positioned such that the sixth valve body is positioned to interrupt fluid communication between the fourth chamber of the first stage and the first chamber of the first stage and the eighth valve body is positioned to interrupt fluid communication between the fourth chamber of the second stage and the first chamber of the second stage.

Another aspect of the invention provides a system for controlling a first module, a second module, a third module, and a fourth module. The system includes: an inlet coupled to a fluid source; a first double-stage valve; a second double-stage valve; and a third double-stage valve. The first double-stage valve is actuatable to: a first position wherein fluid from the inlet flows through the first double-stage valve to the second double-stage valves and a second position wherein fluid from the inlet flows through the first double-stage valve to the third double-stage valves. The second double-stage valve is actuatable to a first position wherein fluid from the first double-stage valve flows through the second double-stage valve to the first module and a second position wherein fluid from the first double-stage valve flows through the second double-stage valve to the second module. The third double-stage valve is actuatable to a first position wherein fluid from the first double-stage valve flows through the third double-stage valve to the third module and a second position wherein fluid from the first double-stage valve flows through the third double-stage valve to the fourth module.

Another aspect of the invention provides a method for drilling a curved hole within a wellbore. The method includes: providing a drill string including a first steering module, a second steering module, a third steering module, an inlet configured to receive fluid from a fluid source, a first double-stage valve, and a second double-stage valve; rotating the drill string and actuating the first and second double-stage valves to permit fluid flow to the first module, second module, and third module to steer the drill string, thereby drilling a curved hole within a wellbore. The first double-stage valve can be actuatable to a first position wherein fluid from the inlet flows through the first double-stage valve to the second double-stage valve and a second position wherein fluid from the inlet flows through the first double-stage valve to the third module. The second double-stage valve can be actuatable to a first position wherein fluid flows from the first double-stage valve to the first module and a second position wherein fluid flows from the first double-stage valve to the second module.

In one embodiment, fluid flows to the first module, second module, and third module in a cyclic pattern.

DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION

Aspects of the invention provide control systems and methods for directional drilling. Various embodiments of the invention can be used in wellsite systems.

Wellsite System

Figure 1:
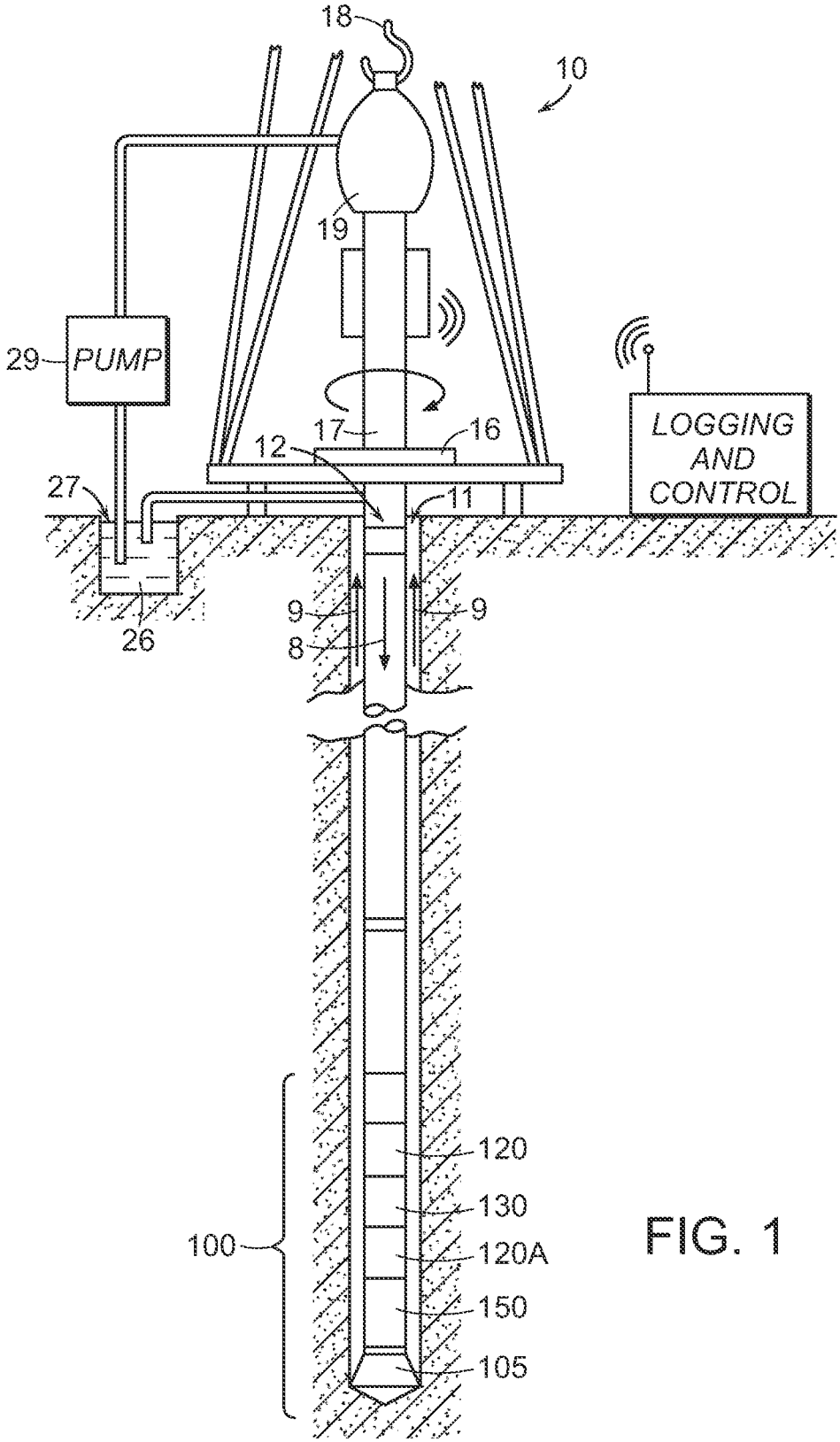
FIG. 1 illustrates a wellsite system in which the present invention can be employed.

FIG. 1 illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly (BHA) 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120, a measuring-while-drilling (MWD) module 130, a roto-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator (also known as a "mud motor") powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling." In this embodiment, a roto-steerable subsystem 150 (FIG. 1) is provided. Directional drilling is the intentional deviation of the wellbore from the path it would naturally take. In other words, directional drilling is the steering of the drill string so that it travels in a desired direction.

Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems.

In the point-the-bit system, the axis of rotation of the drill bit is deviated from the local axis of the bottom hole assembly in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953.

In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form, the drill bit is required to cut side ways in order to generate a curved hole. Examples of push-the-bit type rotary steerable systems and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; and 5,971,085.

Control Devices for Three-Module Systems

Figure 2A:
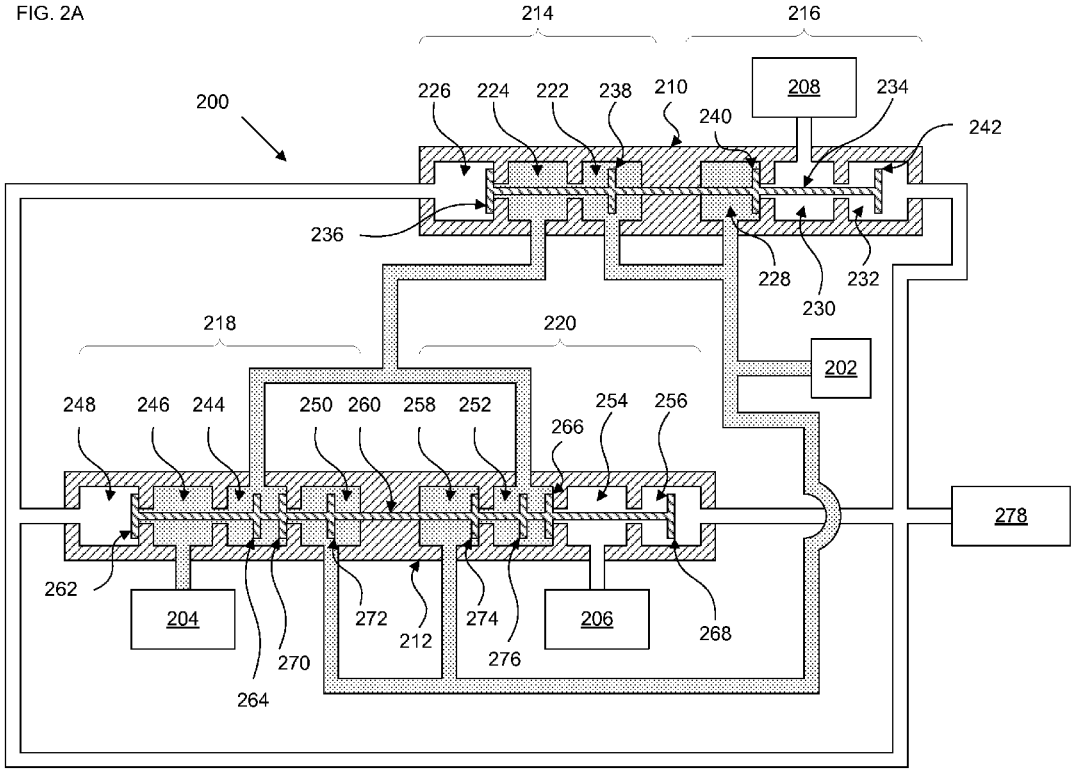
FIGS. 2A-2C illustrates the structure and operation of a control system for selectively permitting flow from an inlet to a first module, a second module, and a third module according to one embodiment of the invention.
Figure 2B:
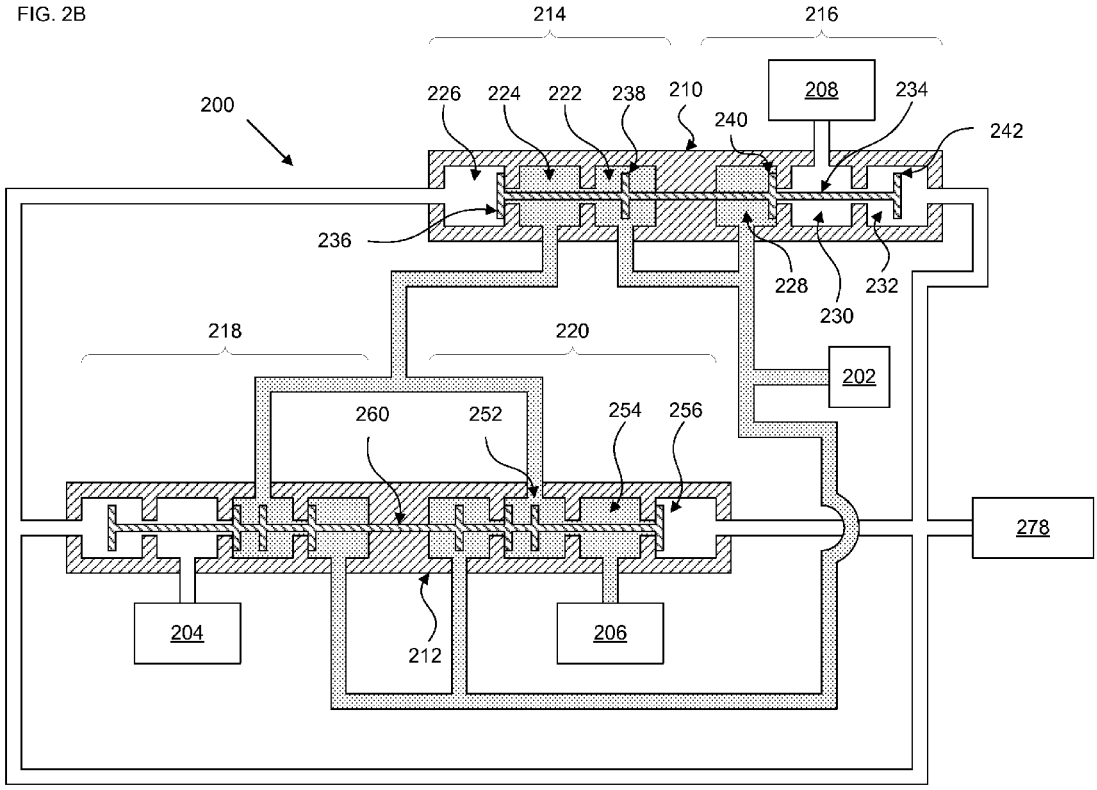
Figure 2C:
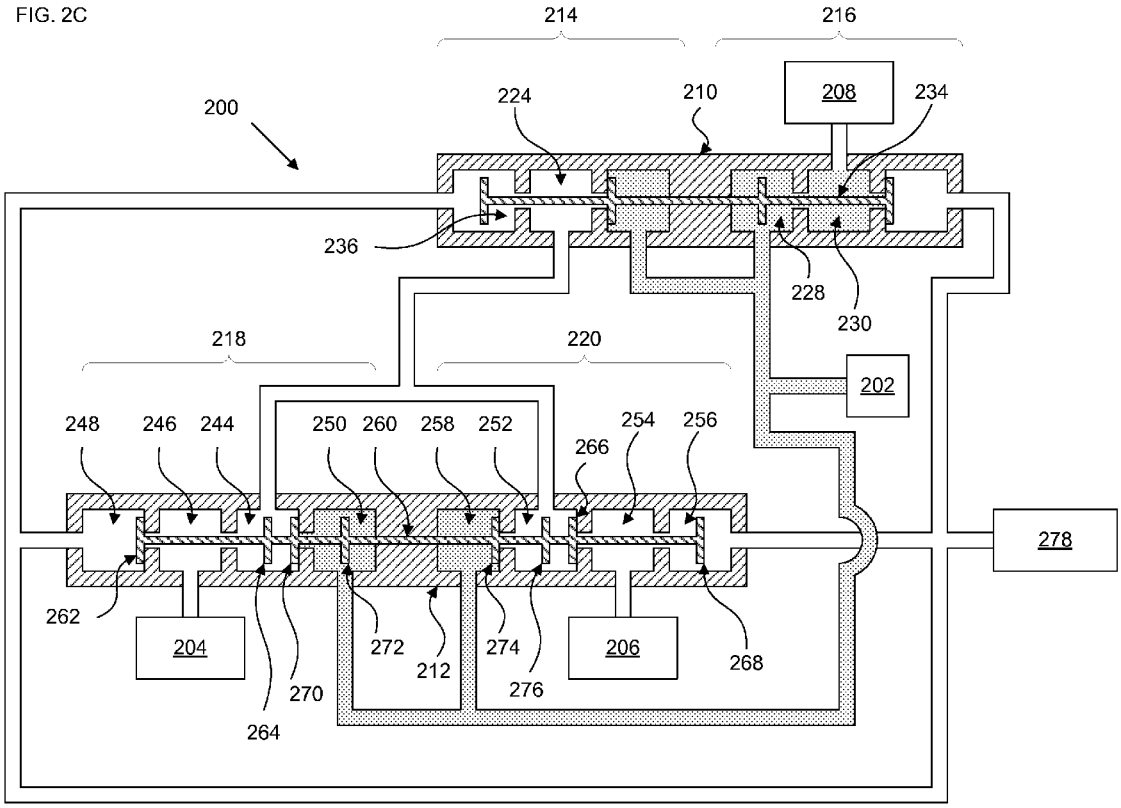

Referring now to FIGS. 2A-2C, a control system 200 according to one embodiment of the invention for selectively permitting flow from an inlet 202 to a first module 204, a second module 206, and a third module 208 is depicted. Control system 200 includes a first double-stage valve 210 and a second double-stage valve 212. The first double-stage valve 210 includes a first stage 214 and a second stage 216. The second double-stage valve 212 includes a first stage 218 and a second stage 220.

The first stage 214 of the first double-stage valve 210 can include a first chamber 222, a second chamber 224 in selective fluid communication with the first chamber 222, and a third chamber 226 in selective fluid communication with the second chamber 224. The second stage 216 of the first double-stage valve 210 includes a first chamber 228, a second chamber 230 in selective fluid communication with the first chamber 228, and a third chamber 232 in selective fluid communication with the second chamber 230.

The first double-stage valve 210 can include shaft 234 received within both stages 214, 216. The shaft 234 can include a first valve body 236 received within the third chamber 226 of the first stage 214, a second valve body 238 received within the first chamber 222 of the first stage 214, a third valve body 240 received within the first chamber 228 of the second stage 216, and a fourth valve body 242 received within the third chamber 232 of the second stage 216.

The first stage 218 of the second double-stage valve 212 can include a first chamber 244, a second chamber 246 in selective fluid communication with the first chamber 244, a third chamber 248 in selective fluid communication with the second chamber 246, and a fourth chamber 250 in selective fluid communication with the first chamber 244. The second stage 220 of the second double-stage valve 212 can include a first chamber 252, a second chamber 254 in selective fluid communication with the first chamber 252, a third chamber 256 in selective fluid communication with the second chamber 254, and a fourth chamber 258 in selective fluid communication with the first chamber 252.

The second double-stage valve 212 can include shaft 260 received within both stages 218, 220. The shaft 260 can include a first valve body 262 received within the third chamber 248 of the first stage 218, a second valve body 264 received within the first chamber 244 of the first stage 218, a third valve body 266 received within the first chamber 252 of the second stage 220, a fourth valve body 268 received within the third chamber 256 of the second stage 220, a fifth valve body 270 received within the first chamber 244 of the first stage 218, a sixth valve body 272 received within the fourth chamber 250 of the first stage 218, a seventh valve body 274 received within the fourth chamber 258 of the second stage 220, and an eighth valve body 276 received within the first chamber 252 of the second stage 220.

Fourth chambers 250, 258 ensure that high pressure is maintained in first chambers 246, 252 when the first valve 210 is actuated to the second position, thereby ensuring fast actuation of first module 204 and second module 206. Additionally or alternatively, fourth chambers 250, 258 could hold pressure-balance elements to seal the actuating device (not depicted) of valve 212 from the working fluid (e.g., mud) received from inlet 202. In such an embodiment, the actuator could be filled with oil at a pressure substantially equal to the pressure within fourth chambers 250, 258, thereby minimizing stress on sealing elements (e.g., bellows, rubber boots, and the like) between the actuator and the fourth chambers 250, 258.

In FIG. 2A, both the first double-stage valve 210 and the second double-stage valve 212 are in first positions. Fluid flows from inlet 202 through the first chamber 222 and second chamber 224 of the first stage 214 of the first double-stage valve 210 to the first chamber 244 and the second chamber 246 of the first stage 218 of the second double-stage valve 212 to the first module 204. Third module 208 is concurrently vented to exhaust 278.

In FIG. 2B, both the first double-stage valve 210 is in the first position and the second double-stage valve 212 is the second position. Fluid flows from inlet 202 through the first chamber 222 and second chamber 224 of the first stage 214 of the first double-stage valve 210 to the first chamber 252 and the second chamber 254 of the second stage 220 of the second double-stage valve 212 to the second module 206. First module 204 and third module 208 are concurrently vented to exhaust 278.

In FIG. 2C, both the first double-stage valve 210 is in the second position and the second double-stage valve 212 is in the first position. Fluid flows from inlet 202 through the first chamber 228 and second chamber 230 of the second stage 216 of the first double-stage valve 210 to the third module 208. First module 204 and second module 206 are concurrently vented to exhaust 278.

Valves 210, 212 can be actuated by a variety of devices. For example, a pinion can interface with a plurality of rack gear teeth on shafts 234, 260. Alternatively, shafts 234, 260 can extend beyond the wall of valves 210, 212 and interface with an external actuator. A variety of valve actuators are described in publications such as T. Christopher Dickenson, *Valves, Piping & Pipelines Handbook* 138-45 (3d ed. 1999); and Peter Smith, *Valve Selection Handbook* (5th ed. 2004).

The actuation of valves 210, 212 can be effected by a control device (not depicted) to maintain the proper angular position of the bottom hole assembly relative to the subsurface formation. In some embodiments, the control device is mounted on a bearing that allows the control device to rotate freely about the axis of the bottom hole assembly. The control device, according to some embodiments, contains sensory equipment such as a direction and inclination (D&I) sensor, rotational speed sensor, accelerometers (e.g., three-axis accelerometers), and/or magnetometer sensors to detect the inclination and azimuth of the bottom hole assembly. The control device can further communicate with sensors disposed within elements of the bottom hole assembly such that said sensors can provide formation characteristics or drilling dynamics data to control unit. Formation characteristics can include information about adjacent geologic formation gather from ultrasound or nuclear imaging devices such as those discussed in U.S. Patent Publication No. 2007/0154341, the contents of which is hereby incorporated by reference herein. Drilling dynamics data may include measurements of the vibration, acceleration, velocity, and temperature of the bottom hole assembly.

In some embodiments, control device is programmed above ground to following a desired inclination and direction. The progress of the bottom hole assembly can be measured using MWD systems and transmitted above-ground via a sequences of pulses in the drilling fluid, via an acoustic or wireless transmission method, or via a wired connection. If the desired path is changed, new instructions can be transmitted as required. Mud communication systems are described in U.S. Patent Publication No. 2006/0131030, herein incorporated by reference. Suitable systems are available under the POWERPULSE™ trademark from Schlumberger Technology Corporation of Sugar Land, Tex.

Figure 3:
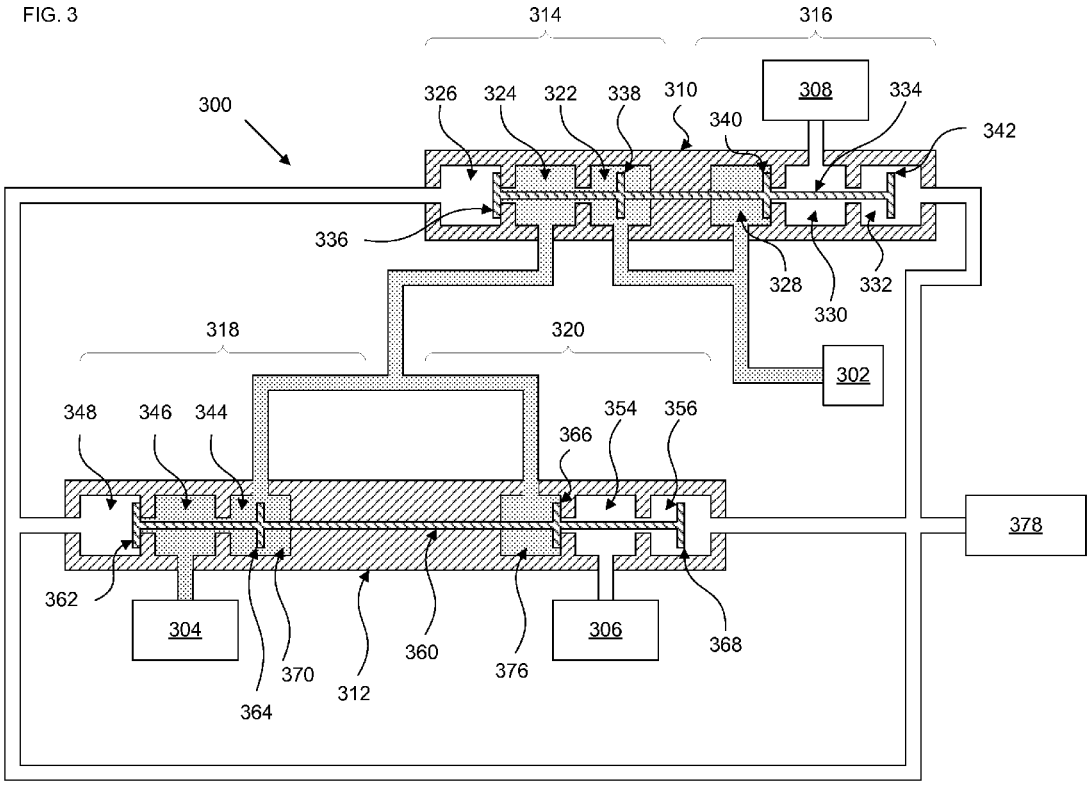
FIG. 3 illustrates an embodiment of the invention without fourth chambers.

Referring to FIG. 3, each stage 218, 220 of second double-stage valve 212 be fabricated without a fourth chamber 250, 258. Such an embodiment can be advantageous due to the simpler valve design and because only a single valve type (i.e., a double-stage, six-chamber valve) is needed in inventory. (The elements in FIG. 3 correspond to like-labeled elements in FIG. 2 and the related description herein.) In such an embodiment, the actuator of the second valve 312 can be coupled with a dynamic oil compensator, which communicates with second chamber 324 of first valve 310.

Figure 4:
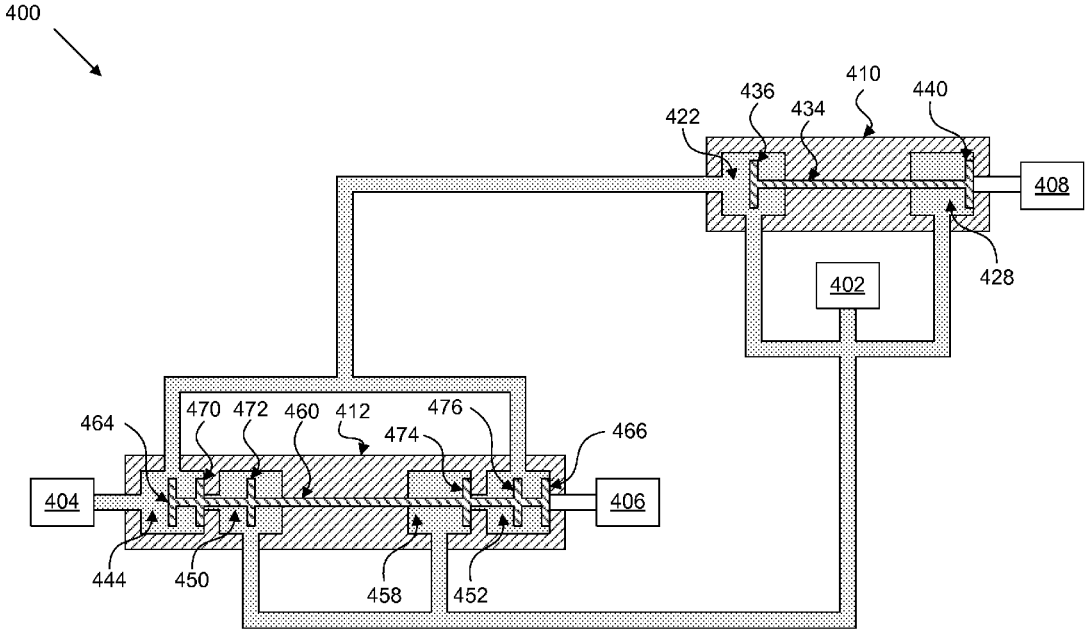
FIG. 4 illustrates an embodiment of the invention that does not process exhaust from the modules.

Referring to FIG. 4, an embodiment of the invention 400 that does not process exhaust from modules 404, 406, 408 is provided. In such an embodiment, modules 404, 406, 408 can include an exhaust port from which exhaust can be vented. As will be appreciated from FIG. 4, chambers 422, 428, 444, 450, 458, and 452 generally correspond to first chambers 222, 228, 244, 250, 258, and 252, respectively, in FIG. 2. Likewise, chambers 450 and 458 can be omitted as discussed above in the context of FIG. 4.

Control Devices for Four-Module Systems

Referring now to FIGS. 5A-5D, a control system 500 for selectively permitting flow from an inlet 502 to a first module 504, a second module 506, a third module 508, and a fourth module 510 is depicted. System 500 includes a first valve 512, a second valve 514, and a third valve 516. Valves 512, 514, 516 can be the same or similar to the valves described herein.

For example, valve 512 can have chambers 518 and 520. Shaft 522 can be received within valve 512 and can include valve body 524 received within chamber 518 and valve body 526 received within chamber 520.

Valve 514 can include chambers 528, 530, 532, and 534. Shaft 536 can be received within valve 514 and can include discs 538 and 540 received within chamber 528, valve body 542 received within chamber 530, valve body 544 received within chamber 532, and discs 546 and 548 received within chamber 534.

Valve 516 can include chambers 550, 552, 554, and 556. Shaft 558 can be received within valve 516 and can include discs 560 and 562 received within chamber 550, valve body 564 received within chamber 552, valve body 560 received within chamber 554, and discs 562 and 564 received within chamber 556.

Figure 5A:
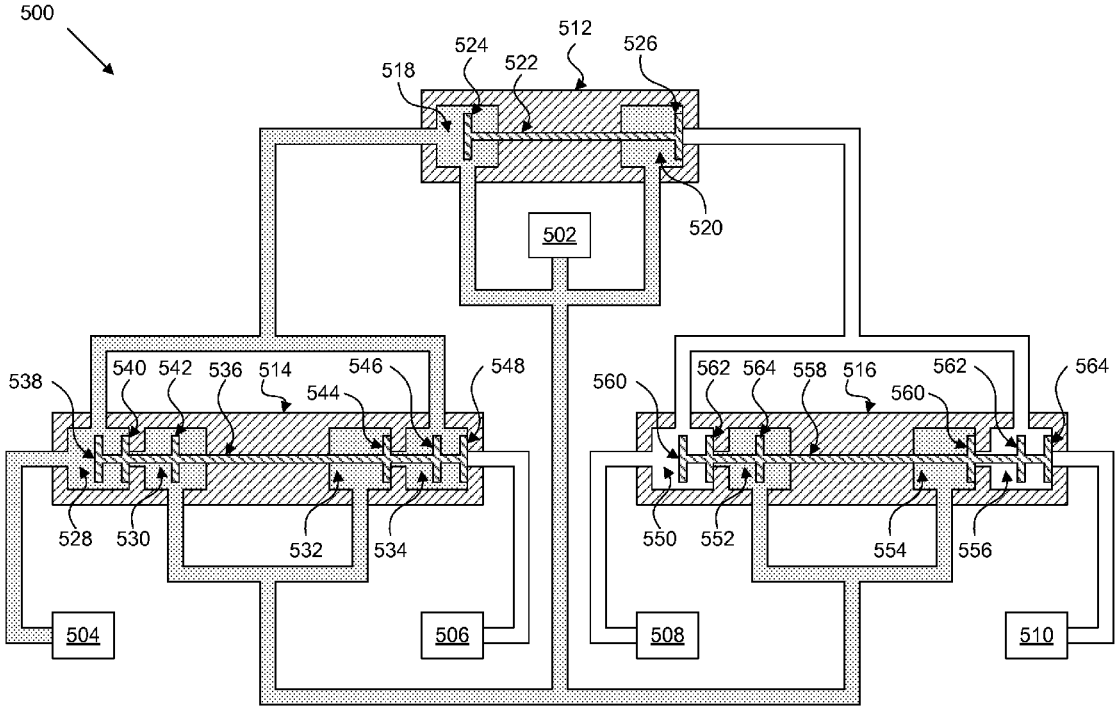
FIGS. 5A-5D depict the structure and operation of a control system for selectively permitting flow from an inlet to a first module, a second module, a third module, and a fourth module according to one embodiment of the invention.
Figure 5B:
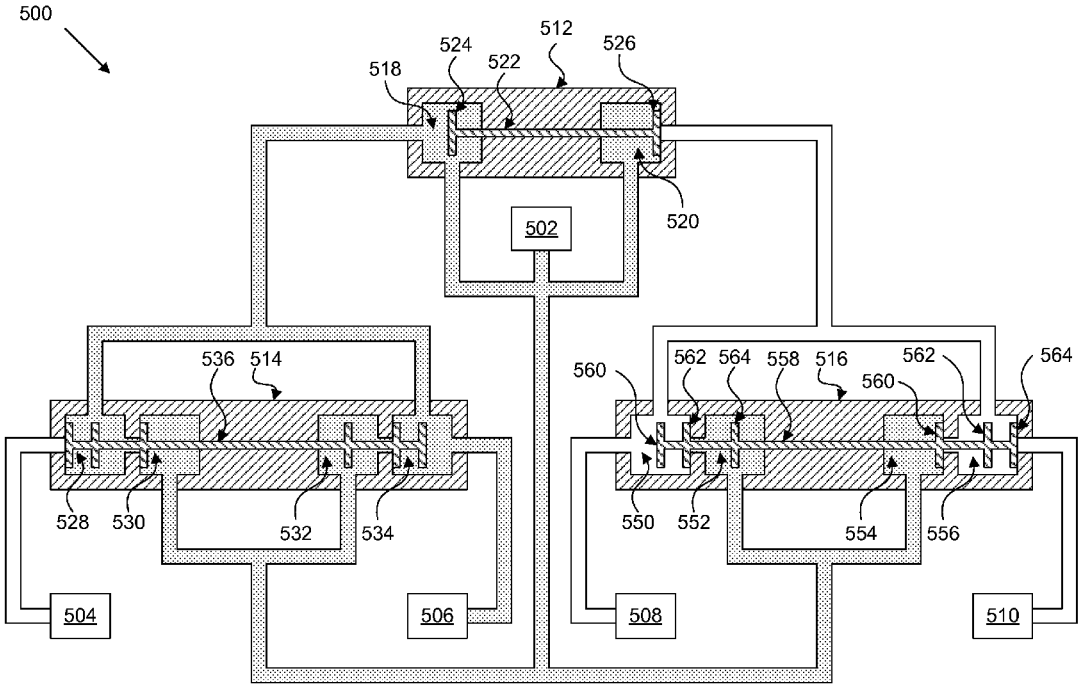
Figure 5C:
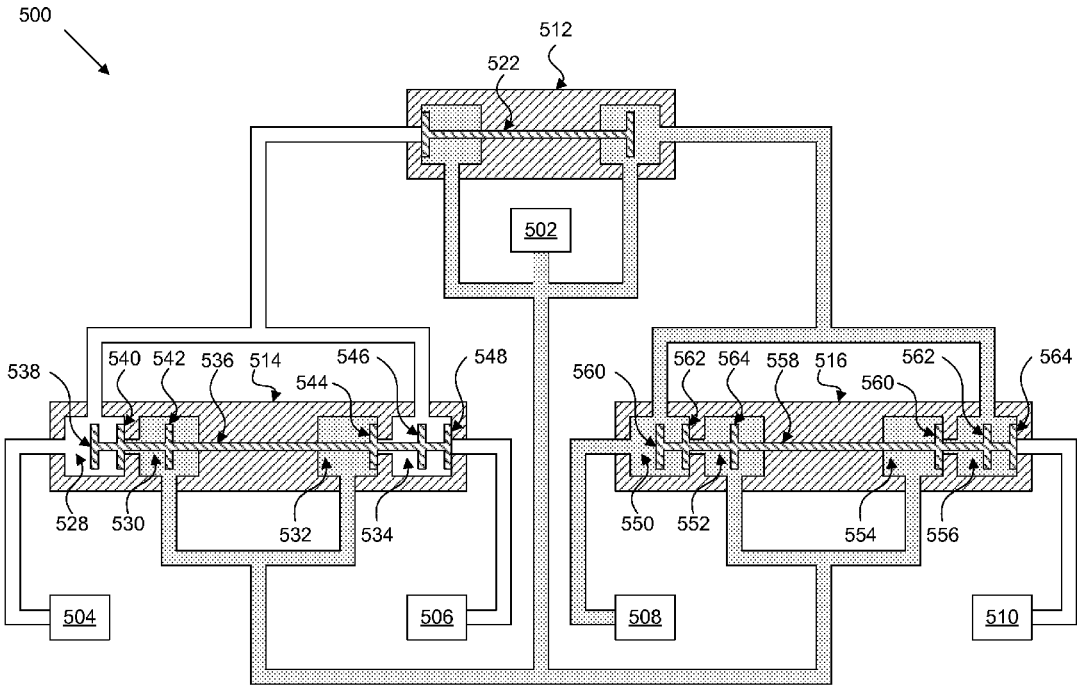
Figure 5D:
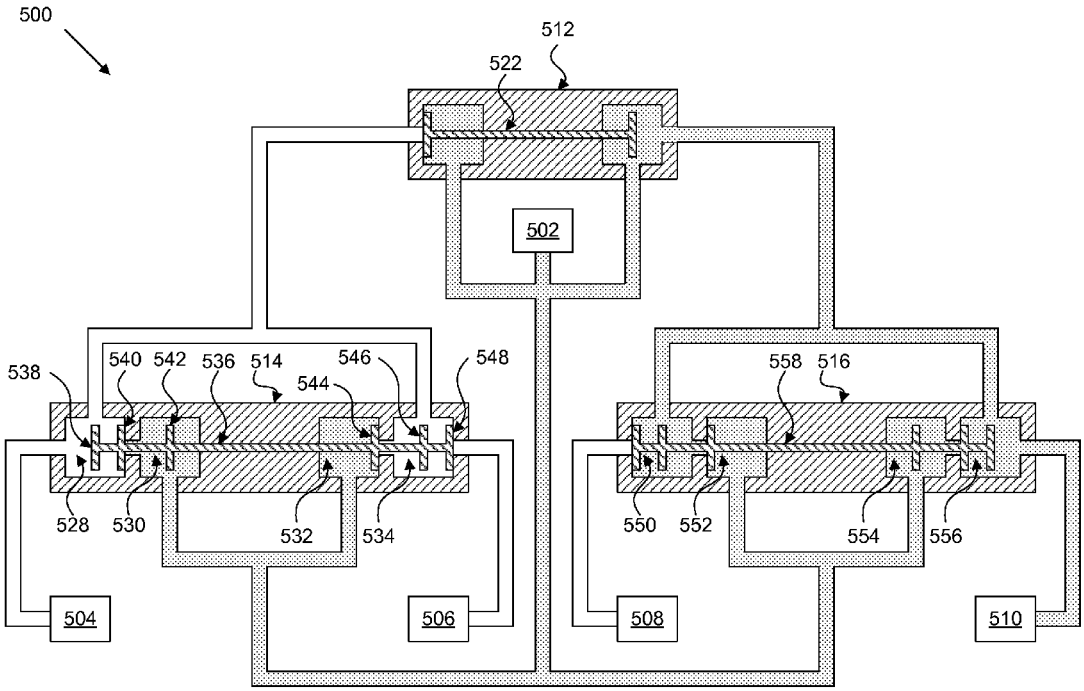

In FIG. 5A, valves 512 and 514 are both actuated to the first positions to permit flow to the first module 504. In FIG. 5B, valve 512 is actuated to the first position and valve 514 is actuated to the second position to permit fluid flow to the second module 506. In FIG. 5C, valve 512 is actuated to the second position and valve 516 is actuated to the first position to permit fluid flow to the third module 508. In FIG. 5D, valve 512 is actuated to the second position and valve 516 is actuated to the second position to permit fluid flow to the fourth module 510.

As will be appreciated by one of skill in the art, the principles of the invention can be applied to control systems having any number of modules. For example, system 500 could be modified to control five modules by placing additional valve in place of any of the modules 504, 506, 508, 510 and coupling two modules to the additional valve.

Thus, to control n modules (n being an integer greater than 1), a system can be fabricated having n−1 valves.

Integration within Drill Strings

The systems described herein can be installed within drill strings, bottom hole assemblies, and the like. In such an embodiment, the inlet 202 can be in fluid communication with the interior of the drill string. The systems can be used to control any hydraulic or pneumatic devices such as bias pads, motors, and the like.

Methods of Directional Drilling

Figure 6:
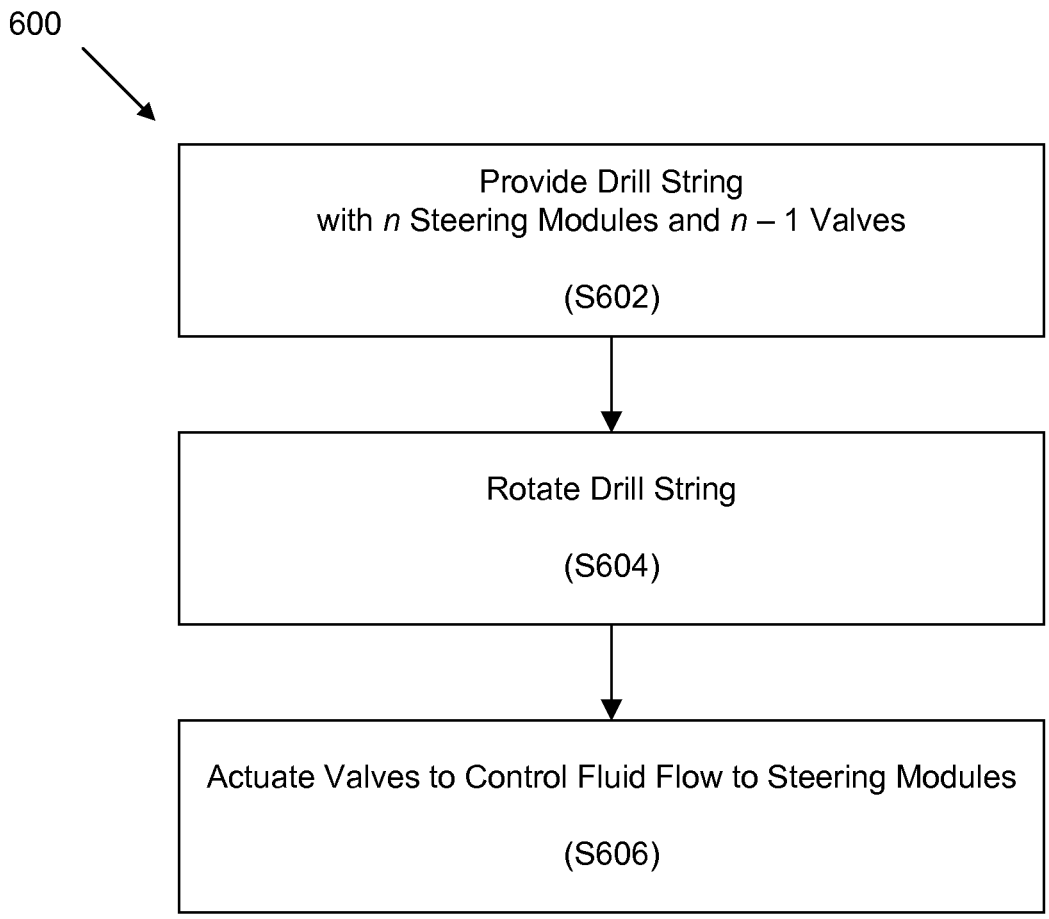
FIG. 6 depicts a method of directional drilling according to one embodiment of the invention.

Referring now to FIG. 6, a method of directional drilling 600 is provided. In step S602, a drill string is provided including a n steering modules, and n−1 valves. Exemplary arrangements of valves and steering modules are described herein. In step S604, the drill string is rotated. In step S606, the valves are actuated to control fluid flow to the steering modules.

INCORPORATION BY REFERENCE

All patents, published patent applications, and other references disclosed herein are hereby expressly incorporated by reference in their entireties by reference.

EQUIVALENTS

Those skilled in the art will recognize, or be able to ascertain using no more than routine experimentation, many equivalents of the specific embodiments of the invention described herein. Such equivalents are intended to be encompassed by the following claims.

The invention claimed is:

1. A system to control a first module, a second module, and a third module, the system comprising:

an inlet configured to receive fluid from a fluid source;

a first double-stage valve; and a second double-stage valve;

wherein the first double-stage valve is actuated to:

a first position wherein fluid from the inlet flows through the first double-stage valve to the second double-stage valve; and a second position wherein fluid from the inlet flows through the first double-stage valve to a third module; and wherein the second double-stage valve is actuated to:

a first position wherein fluid flows from the first double-stage valve to a first module; and a second position wherein fluid flows from the first double-stage valve to a second module; and wherein each of the first module, the second module, and the third module are bias pads.

2. The system of claim 1, wherein the system is received within a drill string.

3. The system of claim 2, wherein the fluid source is pressurized drilling fluid within the drill string.

4. The system of claim 1, wherein the first double-stage valve includes:

a first stage in fluid communication with the inlet and in selective communication with the second double-stage valve;

a second stage in fluid communication with the inlet and in selective communication with the third module; and a shaft received within the first double-stage valve, the shaft including:

a first valve body received within the first stage; and a second valve body received within the second stage.

5. The system of claim 4, wherein during actuation of the first double-stage valve to the second position, the shaft is positioned such that:

the first valve body is positioned to interrupt fluid communication between the inlet and the second double-stage valve; and the second valve body is positioned to permit fluid communication between the inlet and the third module.

6. The system of claim 1, wherein during actuation of the first double-stage valve to the first position, the shaft is positioned such that:

the first valve body is positioned to permit fluid communication between the inlet and the second double-stage valve; and the second valve body is positioned to interrupt fluid communication between the inlet and the third module.

7. The system of claim 1, wherein the second double-stage valve includes:

a first stage having:

a first chamber in fluid communication with the first double-stage valve and in selective communication with the first module;

a second stage having:

a first chamber in fluid communication with the first double-stage valve and in selective communication with the second module;

a shaft received within the second double-stage valve, the shaft including:

a first valve body received within the first stage; and a second valve body received within the second stage.

8. The system of claim 7, wherein during actuation of the second double-stage valve to the first position, the shaft is positioned such that:

the first valve body is positioned to permit fluid communication between the first double-stage valve and the first module; and the second valve body is positioned to interrupt fluid communication between the first double-stage valve and the second module.

9. The system of claim 7, wherein during actuation of the second double-stage valve to the second position, the shaft is positioned such that:

the first valve body is positioned to interrupt fluid communication between the first double-stage valve and the first module; and the second valve body is positioned to permit fluid communication between the first double-stage valve and the second module.

10. The system of claim 7, wherein:

the first stage of the second double-stage valve further includes:

a second chamber in fluid communication with the inlet and in selective fluid communication with the first chamber of the first stage of the second double-stage valve;

the second stage of the second double-stage valve further includes:

a second chamber in fluid communication with the inlet and in selective fluid communication with the first chamber of the second stage of the second double-stage valve; and the shaft further includes:

a third valve body received within the first chamber of the first stage of the second double-stage valve;

a fourth valve body received within the second chamber of the first stage of the second double-stage valve;

a fifth valve body received within the second chamber of the second stage of the second double-stage valve; and a sixth valve body received within the first chamber of the second stage of the second double-stage valve.

11. The system of claim 10, wherein during actuation of the second double-stage valve to the first position, the shaft is positioned such that:

the third valve body is positioned to interrupt fluid communication between the second chamber of the first stage and the first chamber of the first stage; and the fifth valve body is positioned to interrupt fluid communication between the second chamber of the second stage and the first chamber of the second stage.

12. The system of claim 10, wherein during actuation of the second double-stage valve to the second position, the shaft is positioned such that:

the fourth valve body is positioned to interrupt fluid communication between the second chamber of the first stage and the first chamber of the first stage; and the sixth valve body is positioned to interrupt fluid communication between the second chamber of the second stage and the first chamber of the second stage.

13. A system for controlling a first module, a second module, and a third module, the system comprising:

an inlet configured to receive fluid from a fluid source;

a first double-stage valve; and a second double-stage valve;

wherein the first double-stage valve is actuatable to:

a first position wherein fluid from the inlet flows through the first double-stage valve to the second double-stage valve; and a second position wherein fluid from the inlet flows through the first double-stage valve to the third module; and wherein the second double-stage valve is actuatable to:

a first position wherein fluid flows from the first double-stage valve to the first module; and a second position wherein fluid flows from the first double-stage valve to the second module; and an exhaust in communication with the first double-stage valve and the second double stage valve, wherein each of the first module, the second module, and the third module is a hydraulic device.

14. A system for controlling a first module, a second module, and a third module, the system comprising:

an inlet configured to receive fluid from a fluid source;

a first double-stage valve; and a second double-stage valve;

wherein the first double-stage valve is actuatable to:

a first position wherein fluid from the inlet flows through the first double-stage valve to the second double-stage valve; and a second position wherein fluid from the inlet flows through the first double-stage valve to the third module; and wherein the second double-stage valve is actuatable to:

a first position wherein fluid flows from the first double-stage valve to the first module; and a second position wherein fluid flows from the first double-stage valve to the second module; and wherein each of the first module, the second module, and the third module is a hydraulic device, wherein the first double-stage valve includes:

a first stage having:

a first chamber in fluid communication with the inlet;

a second chamber in fluid communication with the second double-stage valve and in selective fluid communication with the first chamber; and a third chamber coupled in fluid communication with an exhaust and in selective fluid communication with the second chamber;

a second stage having:

a first chamber in fluid communication with the inlet;

a second chamber in fluid communication with the third module and in selective fluid communication with the first chamber; and a third chamber coupled in fluid communication with the exhaust and in selective fluid communication with the second chamber; and a shaft received within the first double-stage valve, the shaft including:

a first valve body received within the third chamber of the first stage;

a second valve body received within the first chamber of the first stage;

a third valve body received within the first chamber of the second stage; and a fourth valve body received within the third chamber of the second stage.

15. The system of claim 14, wherein during actuation of the first double-stage valve to the first position the shaft is positioned such that:

the first valve body is positioned to interrupt fluid communication between the third chamber of the first stage and the second chamber of the first stage;

the second valve body is positioned to permit fluid communication between the first chamber of the first stage and the second chamber of the first stage;

the third valve body is positioned to interrupt fluid communication between the first chamber of the second stage and the second chamber of the second stage; and the fourth valve body is positioned to permit fluid communication between the third chamber of the second stage and the third chamber of the second stage.

16. The system of claim 14, wherein during actuation of the first double-stage valve to the second position the shaft is positioned such that:

the first valve body is positioned to permit fluid communication between the third chamber of the first stage and the second chamber of the first stage;

the second valve body is positioned to interrupt fluid communication between the first chamber of the first stage and the second chamber of the first stage;

the third valve body is positioned to permit fluid communication between the first chamber of the second stage and the second chamber of the second stage; and the fourth valve body is positioned to interrupt fluid communication between the third chamber of the second stage and the third chamber of the second stage.

17. A system for controlling a first module, a second module, and a third module, the system comprising:

an inlet configured to receive fluid from a fluid source;

a first double-stage valve; and a second double-stage valve;

wherein the first double-stage valve is actuatable to:

a first position wherein fluid from the inlet flows through the first double-stage valve to the second double-stage valve; and a second position wherein fluid from the inlet flows through the first double-stage valve to the third module; and wherein the second double-stage valve is actuatable to:

a first position wherein fluid flows from the first double-stage valve to the first module; and a second position wherein fluid flows from the first double-stage valve to the second module; and wherein each of the first module, the second module, and the third module is a hydraulic device, wherein the second double-stage valve includes:

a first stage having:

a first chamber in fluid communication with the first double-stage valve;

a second chamber in communication with the first module and in selective fluid communication with the first chamber; and a third chamber in fluid communication an exhaust and in selective fluid communication with the second chamber;

a second stage having:

a first chamber in fluid communication with the first double-stage valve;

a second chamber in communication with the second module and in selective fluid communication with the first chamber; and a third chamber in fluid communication the exhaust and in selective fluid communication with the second chamber; and a shaft received within the first double-stage valve, the shaft including:

a first valve body received within the third chamber of the first stage;

a second valve body received within the first chamber of the first stage;

a third valve body received within the first chamber of the second stage; and a fourth valve body received within the third chamber of the second stage.

18. The system of claim 17, wherein during actuation of the second double-stage valve to the first position, the shaft is positioned such that:

the first valve body is positioned to interrupt fluid communication between the second chamber of the first stage and the third chamber of the first stage;

the second valve body is positioned to permit fluid communication between the first chamber of the first stage and the second chamber of the first stage;

the third valve body is positioned to interrupt fluid communication between the first chamber of the second stage and the second chamber of the second stage; and the fourth valve body is positioned to permit fluid communication between the second chamber of the second stage and the third chamber of the second stage.

19. The system of claim 17, wherein during actuation of the second double-stage valve to the second position, the shaft is positioned such that:

the first valve body is positioned to permit fluid communication between the second chamber of the first stage and the third chamber of the first stage;

the second valve body is positioned to interrupt fluid communication between the first chamber of the first stage and the second chamber of the first stage;

the third valve body is positioned to permit fluid communication between the first chamber of the second stage and the second chamber of the second stage; and the fourth valve body is positioned to interrupt fluid communication between the second chamber of the second stage and the third chamber of the second stage.

20. The system of claim 17, wherein:

the first stage of the second double-stage valve further includes:

a fourth chamber in communication with the inlet and in selective communication with the first chamber of the first stage of the second double-stage valve;

the second stage of the second double-stage valve further includes:

a fourth chamber in communication with the inlet and in selective communication with the first chamber of the second stage of the second double-stage valve; and the shaft further includes:

a fifth valve body received within the first chamber of the first stage of the second double-stage valve;

a sixth valve body received within the first chamber of the fourth stage of the second double-stage valve;

a seventh valve body received within the fourth chamber of the second stage of the second double-stage valve; and an eighth valve body received within the first chamber of the second stage of the second double-stage valve.

21. The system of claim 20, wherein during actuation of the second double-stage valve to the first position, the shaft is positioned such that:

the fifth valve body is positioned to interrupt fluid communication between the fourth chamber of the first stage and the first chamber of the first stage; and the seventh valve body is positioned to interrupt fluid communication between the fourth chamber of the second stage and the first chamber of the second stage.

22. The system of claim 20, wherein during actuation of the second double-stage valve to the second position, the shaft is positioned such that:

the sixth valve body is positioned to interrupt fluid communication between the fourth chamber of the first stage and the first chamber of the first stage; and the eighth valve body is positioned to interrupt fluid communication between the fourth chamber of the second stage and the first chamber of the second stage.

23. A system to control a first module, a second module, a third module, and a fourth module, the system comprising:

an inlet coupled to a fluid source;

a first double-stage valve;

a second double-stage valve; and a third double-stage valve;

wherein the first double-stage valve is actuated to:

a first position wherein the fluid from the inlet flows through the first double-stage valve to the second double-stage valves; and a second position wherein the fluid from the inlet flows through the first double-stage valve to the third double-stage valves;

wherein the second double-stage valve is actuated to:

a first position wherein the fluid from the first double-stage valve flows through the second double-stage valve to a first module; and a second position wherein the fluid from the first double-stage valve flows through the second double-stage valve to a second module;

wherein the third double-stage valve is actuated to:

a first position wherein the fluid from the first double-stage valve flows through the third double-stage valve to a third module; and a second position w wherein the fluid from the first double-stage valve flows through the third double-stage valve to a fourth module; and wherein each of the first module, the second module, the third module, and the fourth modules are bias pads.

24. A method for drilling a curved hole within a wellbore, the method comprising:

utilizing a drill string including:

a first steering module;

a second steering module;

a third steering module;

an inlet configured to receive fluid from a fluid source;

a first double-stage valve;

a second double-stage valve; and an exhaust in communication with the first double-stage valve and the second double stage valve;

actuating the first double-stage valve to:

a first position wherein the fluid from the inlet flows through the first double-stage valve to the second double-stage valve; and a second position wherein the fluid from the inlet flows through the first double-stage valve to the third steering module; and actuating the second double-stage valve to:

a first position wherein the fluid flows from the first double-stage valve to the first steering module; and a second position wherein the fluid flows from the first double-stage valve to the second steering module;

rotating the drill string; and actuating the first and second double-stage valves to permit fluid flow to the first steering module, second steering module, and third steering module to steer the drill string and thereby drilling a curved hole within a wellbore.

25. The method of claim 24, wherein fluid flows to the first steering module, second steering module, and third steering module in a cyclic pattern.

* * * * *